US005826221A

United States Patent [19]

Aoyagi

[11] Patent Number: 5,826,221

[45] Date of Patent: Oct. 20, 1998

[54] VOCAL TRACT PREDICTION COEFFICIENT CODING AND DECODING CIRCUITRY CAPABLE OF ADAPTIVELY SELECTING QUANTIZED VALUES AND INTERPOLATION VALUES

[75] Inventor: Hiromi Aoyagi, Tokyo, Japan

[73] Assignee: Oki Electric Industry Co., Ltd., Tokyo, Japan

[21] Appl. No.: 738,779

[22] Filed: Oct. 29, 1996

[30] Foreign Application Priority Data

Nov. 30, 1995 [JP] Japan ..... 7-312548

[51] Int. Cl.[6] ..... G10L 9/00

[52] U.S. Cl. ..... 704/200; 704/219; 704/261; 704/262

[58] Field of Search ..... 704/200, 203, 704/205, 206, 207, 208, 209, 217, 219, 261, 262, 263, 265

[56] References Cited

U.S. PATENT DOCUMENTS

| | | | |
|---|---|---|---|
| 5,255,339 | 10/1993 | Fette et al. | 704/200 |
| 5,448,680 | 9/1995 | Kang et al. | 704/225 |
| 5,657,420 | 8/1997 | Jacobs et al. | 704/223 |

FOREIGN PATENT DOCUMENTS

| | | |
|---|---|---|
| 73099 | 3/1993 | Japan . |
| 130995 | 5/1994 | Japan . |
| 130998 | 5/1994 | Japan . |
| 130996 | 5/1995 | Japan . |
| 134600 | 5/1995 | Japan . |

OTHER PUBLICATIONS

Furui, Digital Speech Processing, Synthesis, and Recognition, pp. 131, 134, Jan. 1, 1989.

Toshiyuki Nomura et al. "A Study on Efficient Quantization and Interporation Methods for LSP Parameters" The Institute of Electronics,1993, A–142, pp. 1–144.

*Primary Examiner*—David R. Hudspeth
*Assistant Examiner*—Susan Wieland
*Attorney, Agent, or Firm*—Rabin & Champagne, P.C.

[57] ABSTRACT

In vocal tract prediction coefficient coding and decoding circuitry, a vocal tract prediction coefficient converter/quantizer transforms vocal tract prediction coefficients of consecutive subframes constituting a single frame to corresponding LSP (Line Spectrum Pair) coefficients, quantizes the LSP coefficients, and thereby outputs quantized LSP coefficient values together with indexes assigned thereto. A coding mode decision assumes, e.g., three different coding modes based on the above quantized LSP coefficient values, the quantized LSP coefficient value of the fourth subframe of the previous frame, and the above indexes. The decision determines which coding mode should be used to code the current frame, and outputs mode code information and quantization code information. The circuitry is capable of reproducing high quality faithful speeches without resorting to a high mean coding rate even when the vocal tract prediction coefficient noticeably varies within the frame.

8 Claims, 4 Drawing Sheets

| MODE | 1ST SUBFRAME | 2ND SUBFRAME | 3RD SUBFRAME | 4TH SUBFRAME |
|---|---|---|---|---|
| 1 | INTERPOLATION VALUE | INTERPOLATION VALUE | INTERPOLATION VALUE | QUANTIZED VALUE |
| 2 | INTERPOLATION VALUE | QUANTIZED VALUE | INTERPOLATION VALUE | QUANTIZED VALUE |
| 3 | QUANTIZED VALUE | QUANTIZED VALUE | QUANTIZED VALUE | QUANTIZED VALUE |

S
200
201
VOCAL TRACT ANALYZER
a
202A
VOCAL TRACT PREDICTION COEFFICIENT QUANTIZER/ DEQUANTIZER
LspQ, I
M
aq
301A
210
CODING MODE DECISION
M,L
303
212
MULTIPLEXER
W
213
207
eij
208
PERCEPTUAL WEIGHTING FILTER
wij
SQUARE ERROR COMPUTATION
209
i,j
Sij
206
SYNTHESIS FILTER
204
Cgij
gj
205
GAIN TABLE
j
Ci
203
EXCITATION CODEBOOK
i

VOCAL TRACT PREDICTION COEFFICIENT CODING AND DECODING CIRCUITRY CAPABLE OF ADAPTIVELY SELECTING QUANTIZED VALUES AND INTERPOLATION VALUES

BACKGROUND OF THE INVENTION

1. Field of the Invention

The present invention relates to circuitry for coding and decoding vocal tract prediction coefficients and, more particularly, to an implementation for coping with changes in the vocal tract prediction coefficient.

2. Description of the Background Art

Today, the need for a speech coding system whose bit rate is as low as 4 kilobits per second or below is increasing in the field of the second generation digital mobile phones, among others. As to the coding and decoding of speech, a system of the type separating sound source information and vocal tract information and coding them separately is predominant over the other systems. This type of system includes a CELP (Code Excited Linear Prediction) coding system and an MPE (Multi-Pulse Excitation) linear prediction coding system.

The prerequisite with, e.g., the CELP system, is that not only the sound source but also LSP (Line Spectrum Pair) parameters be efficiently quantized in order to lower the bit rate. The CELP system subdivides a frame having a preselected interval into subframes and executes processing with each subframe. Therefore, for the quantization of the LSP, how the LSP determined in each frame is interpolated subframe by subframe is important in lowering the bit rate without deteriorating speech quality.

A method of coding vocal tract information is taught in, e.g., Nomura et al. "A Study on Efficient Quantization and Interpolation Methods for LSP parameters", The Institute of Electronics, Information and Communication Engineers of Japan, Proceedings of the Autumn Session, 1993, A-142, p. 1–144. A combination of quantization and interpolation is discussed in the above document for the purpose of enhancing the quantizing ability as to the entire frame. In the document, vocal tract prediction coefficients or LSP parameters are quantized frame by frame while interpolation values are used for subframe processing. Specifically, candidates for the quantized value of the current frame are selected beforehand, and then interpolation is effected with each subframe by use of the candidates and the quantized value of the previous frame.

Regarding quantization, many bits must be allocated to interpolation in order to enhance the quantizing ability as to the entire frame. This requires a quantizer with a smaller number of bits and smaller distortion. In light of this, vector-scalar quantization and multistage-division vector quantization has been studied.

It is generally accepted that high quality sound can be reproduced if the LSP parameters are quantized subframe by subframe. This kind of scheme, however, is not practicable without increasing the bit rate. To solve this problem, quantization is executed with each frame, and then the quantized value of the current frame and that of the previous frame are used to determine an interpolation value for each subframe. For the interpolation, there are available a method using direct interpolation values and a method using vector-quantizing direct interpolation errors. It is considered more effective to represent an interpolation vector xi by using an interpolation coefficient a, e.g., $xi=axp+(1-a)xn$, where xn and xp are respectively the quantized value of the current frame and that of the previous frame, than to represent it by a liner interpolation value.

A method of scalar-quantizing the interpolation coefficient a and a method of scalar-quantizing it and then vector-quantizing the error vector e thereof are now under study. The interpolation vector xi is expressed as $xi=axp+(1-a)xn$. The combination of interpolation coefficient and error vector enhances the error vector quantizing ability more than when only the linear interpolation is used.

However, the problem is that the vocal tract information is apt to noticeably vary within the frame, depending on the input speech. The conventional interpolation scheme cannot sufficiently follow such a variation of the vocal tract information, resulting in the fall of speech quality.

SUMMARY OF THE INVENTION

It is therefore an object of the present invention to provide vocal tract coefficient coding and decoding circuitry capable of outputting, even when the vocal tract prediction coefficient noticeably varies within the frame, a reproduced speech faithfully with high quality without any noticeable increase in mean coding rate.

In accordance with the present invention, vocal tract prediction coefficient coding and decoding circuitry has a coding circuit for producing a vocal tract prediction coefficient from a speech signal input in the form of a frame, and coding it to thereby output a coded signal, and a decoding circuit reproduces a vocal tract prediction coefficient from the coded signal received from the coding circuit. The coding circuit includes a vocal tract prediction coefficient generating section for generating a vocal tract prediction coefficient with each of a plurality of subframes constituting the current frame of the speech signal. A quantizing section determines an LSP coefficient with each of the vocal tract prediction coefficients of the subframes, and quantizes the resulting LSP coefficients to thereby output corresponding quantized LSP coefficient values. A coding mode decision section analyzes the variation of vocal tract prediction coefficient in the current frame on the basis of the quantized LSP coefficient values to thereby select either of a quantize mode and an interpolate mode prepared beforehand for selectively using a quantized value or an interpolation value as the individual vocal tract prediction coefficient, and generates quantize/interpolate mode information representative of the quantize mode or the interpolate mode determined and quantized LSP coefficient value information showing which of the quantized LSP coefficient values of the subframes should be sent. The decoding circuit includes an LSP coefficient reproducing section for reproducing the LSP coefficients of the subframes of the current frame on the basis of the quantize/interpolate mode information and quantized LSP coefficient value information. A vocal tract coefficient reproducing section reproduces the vocal tract prediction coefficients of the subframes from the LSP coefficients of the subframes.

Also, in accordance with the present invention, a vocal tract prediction coefficient processing system includes a vocal tract prediction coefficient generating section for generating a vocal tract prediction coefficient with each of a plurality of subframes constituting the current frame of the speech signal. A quantizing section determines an LSP coefficient with each of the vocal tract prediction coefficients of subframes, and quantizes the resulting LSP coefficients to thereby output corresponding quantized LSP coefficient values. A processing section analyzes the variation of the vocal tract prediction coefficient in the current frame on the basis of the quantized LSP coefficient values to thereby determine either of a quantize mode and an interpolate mode prepared beforehand for selectively using a quantized value or an interpolation value as the individual vocal tract prediction coefficient. A coding mode decision section generates, based on the result of analysis output from the processing section, quantize/interpolate mode information representative of the quantize mode or the interpolate mode determined by the processing means and quantized LSP coefficient value information showing which of the quantized LSP coefficient values of the subframes should be sent.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENT

Figure 1:
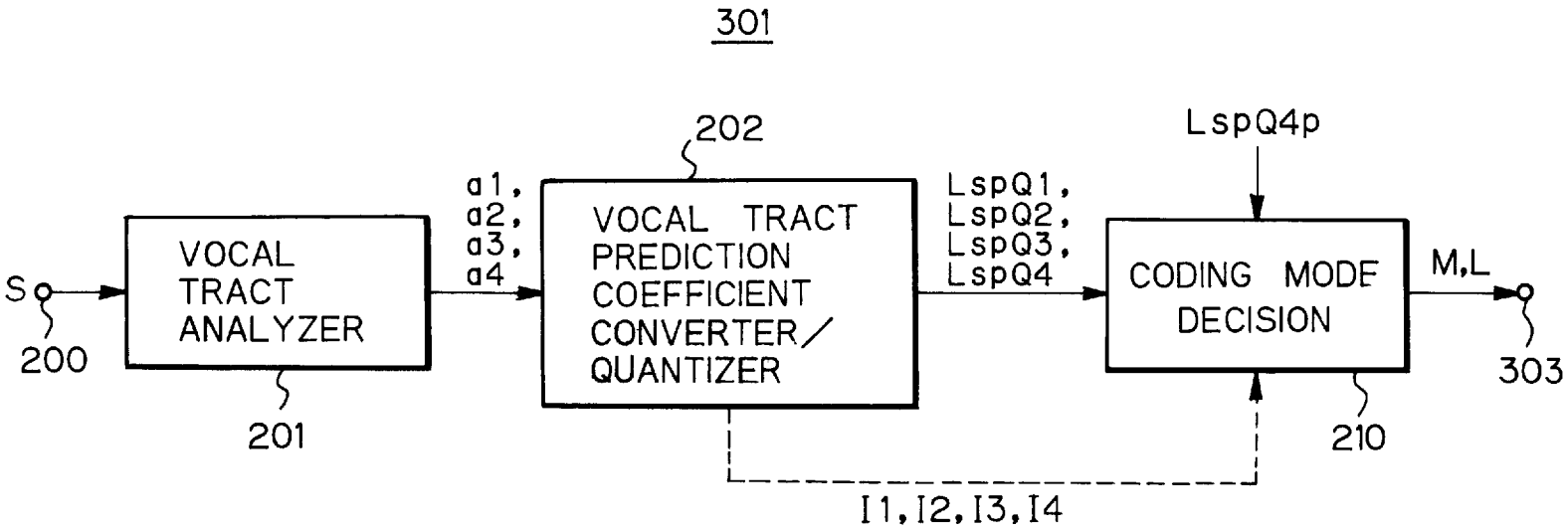
FIG. 1 is a block diagram schematically showing a vocal tract prediction coefficient coding circuit included in vocal tract prediction coefficient coding and decoding circuitry embodying the present invention.

Referring to FIG. 1 of the drawings, a vocal tract prediction coefficient coding circuit included in circuitry embodying the present invention is shown. Briefly, the coding circuit adaptively selects either a quantized value or an interpolation value as a subframe-by-subframe vocal tract prediction coefficient, depending on the variation of vocal tract information within a frame. Quantized values need coding bits while interpolation values do not need them. As a result, the number of coding bits is variable frame by frame.

As shown in FIG. 1, the coding circuit, generally 301, has a vocal tract analyzer 201, a vocal tract prediction coefficient converter/quantizer 202, and a coding mode decision block 210. The vocal tract analyzer 201 receives an input speech signal S in the form of consecutive frames. The analyzer 201 determines a vocal tract prediction coefficient or LPC (Linear Prediction Coding) coefficient a with each subframe of each frame and feeds it to the vocal tract prediction coefficient converter/quantizer 202. In the illustrative embodiment, a single frame is assumed to consist of four consecutive subframes, so that four vocal tract prediction coefficients a1, a2, a3 and a4 are fed from the analyzer 201 to the converter/quantizer 202.

The converter/quantizer 202 converts the input prediction coefficients or LPC coefficients a1–a4 to corresponding LSP coefficients, quantizes the LSP coefficients, and thereby outputs quantized LSP coefficient values LspQ1, LspQ2, LspQ3 and LspQ4. The quantized values LspQ1–LspQ4 are applied to the coding mode decision block 210. At this instant, the converter/quantizer 202 assigns indexes or codes I1, I2, I3 and I4 to the quantized values LspQ1–LspQ4, respectively, and delivers them to the coding mode decision block 210 also.

The coding mode decision block 210 assumes three different modes (see FIG. 2) on the basis of the above quantized LSP coefficient values LspQ1–LspQ4, the LSP coefficient quantized value LspQ4p of the fourth subframe of the previous frame, and the indexes I1–I4 assigned to the values LspQ1–LspQ4. The decision block 210 determines which of the three modes should be used to code the current frame. Then, the decision block 210 delivers mode code information (quantize/interpolate mode information) M and quantization code information (quantized LSP coefficient information) L to an output 303.

Figures 2, 3:
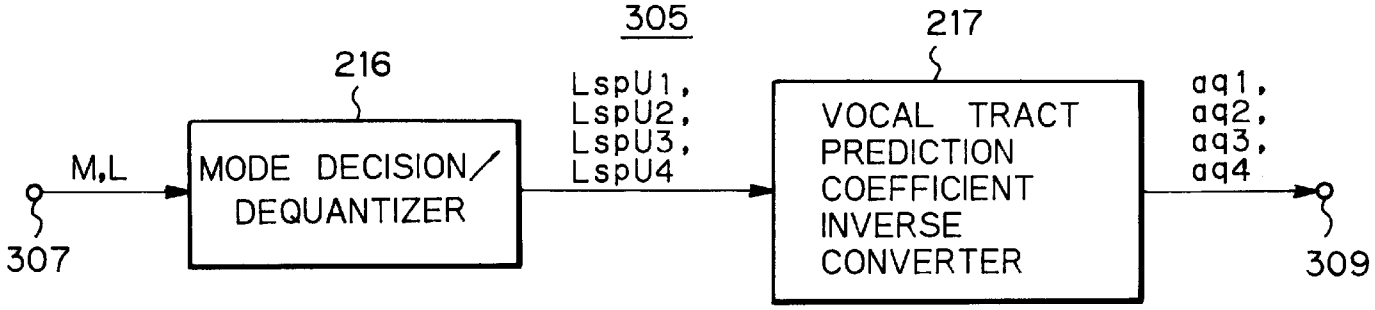
FIG. 2 is a table listing three different coding modes particular to the embodiment shown in FIG. 1.
FIG. 3 is a block diagram schematically showing a vocal tract prediction coefficient decoding circuit also included in the embodiment.

Specifically, FIG. 2 shows a first, a second and a third coding mode 1, 2 and 3 selectively applied to the current mode. In the mode 1, interpolation values are used with the first, second and third subframes while the quantized value is used with the fourth subframe. In the mode 2, interpolation values are used with the first and third subframes while the quantized values are used with the second and fourth subframes. In the mode 3, the quantized values are used with all of the first to fourth subframes; that is, interpolation is not effected at all.

The decision block 210 selects one of the modes 1–3 for the current frame, as follows. First, by using the quantized value LspQ4p of the fourth subframe of the previous frame and the quantized value LspQ4 of the fourth subframe of the current frame, the decision block 210 computes LSP coefficient interpolation values LspD1, LspD2 and LspD3 for the first to third subframes of the current frame. To produce the interpolation values LspD1–LspD3, the following specific equations may be used:

$$\text{LspD1}=\text{LspQ4p}*\tfrac{3}{4}+\text{LspQ4}*\tfrac{1}{4}$$

$$\text{LspD2}=\text{LspQ4p}*\tfrac{2}{4}+\text{LspQ4}*\tfrac{2}{4}$$

$$\text{LspD3}=\text{LspQ4p}*\tfrac{1}{4}+\text{LspQ4}*\tfrac{3}{4}$$

where the symbol "*" is representative of multiplication.

Subsequently, the decision block 210 determines a frame error E1 with the following computation:

$$\text{E1}=\Sigma(\text{LspQ1i}*\text{LspD1i})^2+\Sigma(\text{LspQ2i}-\text{LspD2i})^2+\Sigma(\text{LspQ3i}*\text{LspD3i})^2$$

wherein i is 1 to n which is about 8 or 10.

If the frame error E1 is smaller than a preselected threshold Et1, the decision block 210 determines that the current frame should be coded in the mode 1. Then, the decision block 210 sends the mode code information M representative of the mode 1 and the quantization code information L (only the index I4 in this case) to a vocal tract prediction coefficient decoding circuit 305 (see FIG. 3) also included in the illustrative embodiment. After sending the information M and L, the decision block 210 ends the coding procedure with the current frame.

On the other hand, if the frame error E1 is greater than the threshold Et1, then the decision block 210 computes LSP coefficient interpolation values LspDD1 and LspDD3 for the first and third subframes, respectively, using the quantized values LspQ4p, LspQ2 and LspQ4. To determine the interpolation values LspDD1 and LspDD3, the following equations may be used:

$$\text{LspDD1}=\text{LspQ4p}*\tfrac{1}{2}+\text{LspQ2}*\tfrac{1}{2}$$

$$\text{LspDD3}=\text{LspQ2}*\tfrac{1}{2}+\text{LspQ4}*\tfrac{1}{2}$$

Subsequently, the decision block 210 produces a frame error E2 with an equation:

$$E2=\Sigma(LspQ1i-LspDD1i)^2+\Leftrightarrow(LspQ3i\times LspDD3i)^2$$

where i is 1 to n which is about 8 or 10.

If the frame error E2 is smaller than another preselected threshold Et2, then the decision block 210 determines that the mode 2 should be applied to the current frame. In this case, the decision block 210 delivers the mode code information M representative of the mode 2 and the quantization code information L, i.e., indexes I2 and I4 to the decoding circuit 305. Then, the decision block 210 ends the coding operation with the current frame. If the frame error E2 is greater than the threshold Et2, then the decision block 210 determines that the mode 3 should be applied to the current frame, delivers the mode code information M representative of the mode 3 and the quantization code information, i.e., indexes I1, I2, I3 and I4 to the decoding circuit 305, and ends the processing with the current frame.

As stated above, in the illustrative embodiment, the coding circuit 301 produces a vocal tract prediction coefficient with each of a plurality of subframes constituting the current frame. The subframe-by-subframe prediction coefficients are quantized to produce quantized values and indexes thereof. After interpolation values have been calculated for the consecutive subframes, differences between them and the quantized values are produced. Which of the quantized value and interpolation value should be used is determined subframe by subframe on the basis of the above differences. As for the subframe or subframes to which the quantized values should be assigned, the result of the decision is sent to the decoding circuit 305 together with the associated indexes.

As shown in FIG. 3, the vocal tract prediction coefficient decoding circuit 305 is made up of a mode decision/dequantizer 216 and a vocal tract prediction coefficient inverse converter 217. The mode code information M and quantization code information L received from the coding circuit 301 are input to the mode decision/dequantizer 216 via an input 307. The mode decision/dequantizer 216 computes, based on the information M and L, LSP coefficients LspU1, LspU2, LspU3 and LspU4 to be assigned to the first to fourth subframes, respectively, as follows.

First, the dequantizer 216 separates the index I4 from the information L and then computes a dequantized value LspQ4 for the fourth subframe. If the information M is representative of the mode 1, then the dequantizer 216 computes the LSP coefficients LspU1–LspU4 by use of the quantized value LspQ4p of the fourth subframe of the previous frame and the quantized value LspQ4 of the fourth frame of the current frame. Specific equations available for this purpose are:

$$LspU1=LspQ4p*\tfrac{3}{4}+LspQ4*\tfrac{1}{4}$$

$$LspU2=LspQ4p*\tfrac{2}{4}+LspQ4*\tfrac{2}{4}$$

$$LspU3=LspQ4p*\tfrac{1}{4}+LspQ4*\tfrac{3}{4}$$

$$LspU4=LspQ4$$

If the information M is representative of the mode 2, then the dequantizer 216 separates the index I2 from the information L and computes, based on the index I2, a dequantized value LspQ2 for the second subframe. Then, by using the quantized values LspQ4p, LspQ2 and LspQ4, the dequantizer 216 produces the LSP coefficients LspU1–LspU4. For this purpose, the following specific equations may be used:

$$LspU1=LspQ4p*\tfrac{1}{2}+LspQ2*\tfrac{1}{2}$$

$$LspU2=LspQ2$$

$$LspU3=LspQ2*\tfrac{1}{2}+LspQ4*\tfrac{1}{2}$$

$$LspU4=LspQ4$$

Further, if the information M is representative of the mode 3, then the dequantizer 216 separates the indexes I1 and I3 from the information L and computes, based on the indexes I1 and I3, dequantized values LspQ1 and LspQ3 for the first and third subframes, respectively. Then, by using the quantized values LspQ1, LspQ2, LspQ3 and LspQ4, the dequantizer 216 produces the LSP coefficients UspU1–UspU4 with the following specific equations:

$$LspU1=LspQ1$$

$$LspU2=LspQ2$$

$$LspU3=LspQ3$$

$$LspU4=LspQ4$$

The LSP coefficients UspU1–UspU4computed in any one of the above modes 1–3 are fed to the vocal tract prediction coefficient inverse converter 217. The inverse converter 217 transforms the input LSP coefficients LspU1–LspU4 to vocal tract prediction coefficients aq1–aq4, respectively. The coefficients aq1–aq4 appear on an output terminal 309.

As stated above, in the illustrative embodiment, the decoding circuit 305 decodes the vocal tract prediction coefficients subframe by subframe on the basis of the information received from the coding circuit 301.

Figure 4:
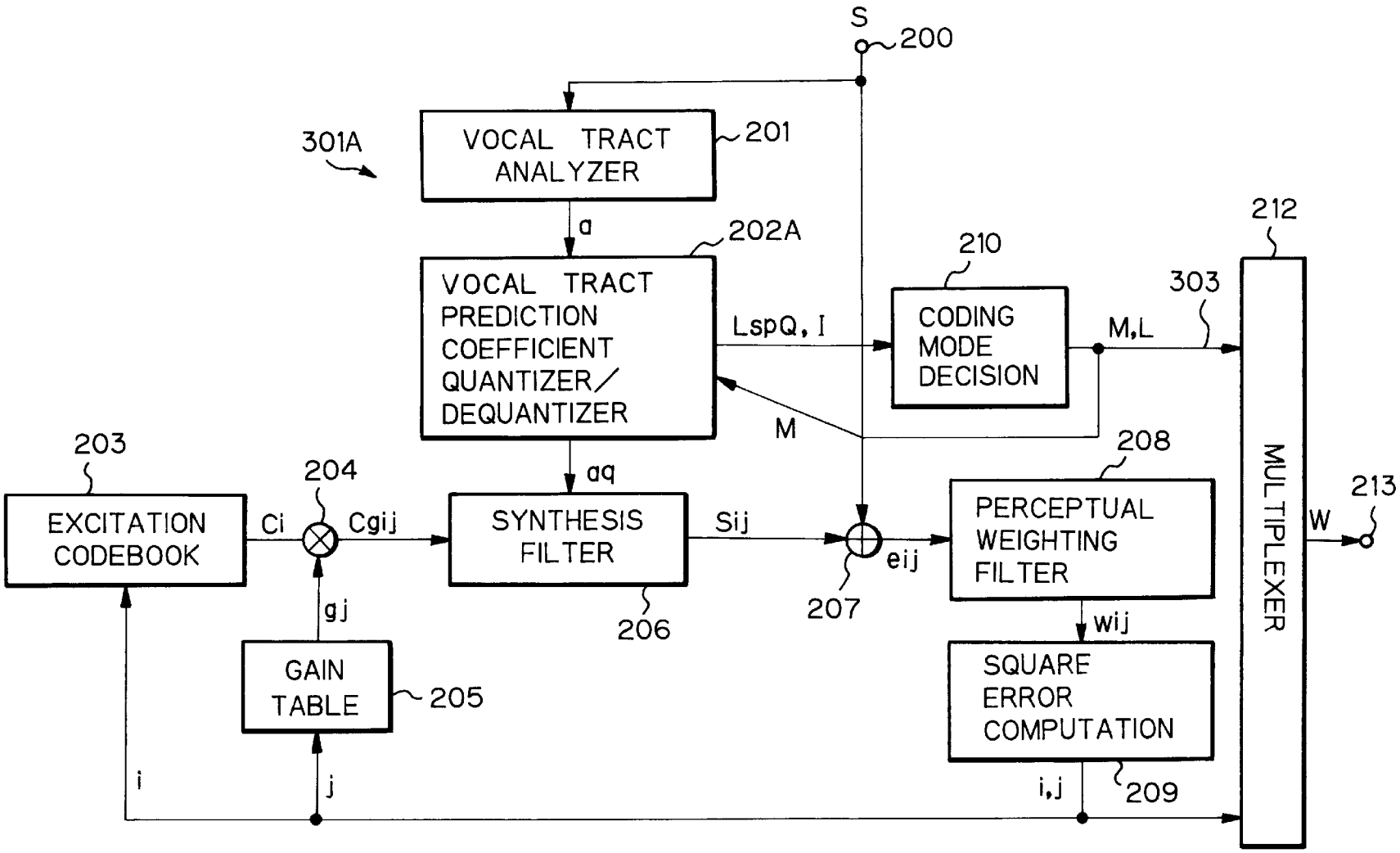
FIG. 4 is a block diagram schematically showing a speech coder to which the coding circuit shown in FIG. 1 is applied.

Referring to FIG. 4, a speech coder including a coding circuit 301A will be described. The coding circuit 301A is a modified form of the coding circuit 301 shown in FIG. 1. In FIG. 4, structural elements identical with the elements shown in FIG. 1 are designated by identical reference numerals, and a detailed description thereof will not be made in order to avoid redundancy. As shown, the speech coder 310A has the vocal tract analyzer 201, a vocal tract prediction coefficient converter/quantizer/dequantizer 202A, an excitation codebook 203, a multiplier 204, a gain table 205, a synthesis filter 206, a subtracter 207, a perceptual weighting filter 208, a square error computation block 209, the coding mode decision block 210, and a multiplexer 212.

The converter/quantizer/dequantizer 202A has an inverse quantizing function in addition to the functions of the converter/quantizer 202 shown in FIG. 1. Specifically, the converter/quantizer/dequantizer 202A transforms the vocal tract prediction coefficients or LPC coefficients a1–a4 output from the analyzer 201 to the LSP coefficients and quantizes the LSP coefficients to produce the quantized LSP coefficient values LspQ1–LspQ4. The quantized values LspQ1–LspQ4 are fed to the coding mode decision block 210 together with their indexes or codes I1–I4, as stated earlier. Further, the converter/quantizer/dequantizer 202A computes dequantized values aq corresponding to the quantized values on the basis of the quantized values LspQ1–LspQ4 and mode code information M. The values aq are applied to the synthesis filter 206.

The excitation codebook 203 receives an index i from the square error computation block 209. In response, the codebook 203 reads out an excitation signal Ci (i=1 through N) designated by the index i and delivers it to the multiplier 204. The multiplier 204 multiplies the excitation signal Ci by gain information gi (j=1 through M) received from the gain table 205, thereby producing a product signal Cgij. The product signal Cgij is fed to the synthesis filter 206.

Specifically, the gain table 205 reads out gain information gj designated by the index j received from the square error computation block 209. The gain information gj is applied to the multiplier 204. The synthesis filter 206 is implemented as, e.g., a cyclic digital filter and receives the dequantized values aq (meaning the LPC coefficients) output from the quantizer/dequantizer 202A and the product signal Cgij output from the multiplier 204. The filter 206 outputs a synthetic speech signal Sij based on the values aq and signal Cgij and delivers it to the subtracter 207. The subtracter 207 produces a difference eij between the original speech signal S input via the input terminal 200 and the synthetic speech signal Sij. The difference eij is applied to the perceptual weighting filter 208.

The perceptual weighting filter 208 weights the difference signal eij with respect to frequency. Stated another way, the weighting filter 208 weights the difference signal eij in accordance with the auditory sense characteristic. A weighted signal wij output from the weighting filter 208 is fed to the square error computation block 209. Generally, as for the speech formant or the pitch harmonics, quantization noise lying in the frequency range of great power sounds low to the ear due to the auditory masking effect. Conversely, quantization noise lying in the frequency of small power sounds as it is without being masked. The above terms "perceptual weighting" therefore refer to frequency weighting which enhances quantization noise lying in the frequency range of great power while suppressing quantization noise lying in the frequency range of small power.

More specifically, the human auditory sense has a so-called masking characteristic; if a certain frequency component is loud, frequencies around it are difficult to hear. Therefore, the difference between the original speech and the synthetic speech with respect to the auditory sense, i.e., how much a synthetic speech sounds distorted does not always correspond to the Euclid distance. This is why the difference between the original speech and the synthetic speech is passed through the weighting filter 208. The resulting output of the weighting filter 208 is used as a distance scale. The weighting filter 208 reduces the distortion of loud portions on the frequency axis while increasing that of low portions.

The square error computation block 209 produces a square sum Eij with each of the components included in the weighted signal wij. Then, the computation block 209 searches for a combination of indexes i and j which makes the square sum Eij smallest. The computation block 209 feeds the optimal index i to the drive sound source codebook 203, feeds the optimal index j to the gain table 205, and feeds both of them to the mutiplexer 212. The multiplexer 212 multiplexes the mode code information M and quantization code information L received from the decision block 210 and the optimal indexes i and j output from the computation block 209. The multiplexed signal, i.e., a total code signal W appears on a total code output terminal 213.

The operation of the speech coder shown in FIG. 4 will be operated as follows. The original speech signal S comes in through the input terminal 200 frame by frame. The voice tract analyzer 201 outputs the voice tract prediction coefficients or LPC coefficients a1–a4 on a subframe-by-subframe basis. The converter/quantizer/dequantizer 202A transforms the prediction coefficients a1–a4 to corresponding LSP coefficients and quantizes the LSP coefficients to thereby output quantized LSP coefficient values LspQ1–LspQ4. At the same time, the dequantizer 202A outputs indexes or codes I1–I4 respectively assigned to the values LspQ1–LspQ4.

The coding mode decision block 210 selects one of the previously stated three modes 1–3 for coding the current frame on the basis of the quantized values LspQ4 of the fourth subframe of the current frame, the quantized value LspQ4p of the fourth subframe of the previous frame, and the indexes I1–I4. The decision block 210 feeds the resulting mode code information M and quantization code information L to the multiplexer 212 while feeding the information M to the converter/quantizer/dequantizer 202A also.

On the other hand, the excitation codebook 203 initially reads out a preselected excitation signal Ci (i being any one of 1 through 15 N). Likewise, the gain table 205 initially reads out preselected gain information gj (j being any one of 1 through M). The multiplier 204 multiplies the excitation signal Ci by gain information gj and feeds the resulting product signal Cgij to the synthesis filter 206. The synthesis filter 206 performs digital filtering with the product signal Cgij and dequantized values aq and outputs the resulting synthetic speech signal Sij. The subtracter 207 produces a difference between the original speech signal S and the synthetic speech signal Sij. A signal eij representative of the above difference is fed from the subtracter 207 to the perceptual weighting filter 208.

The weighting filter 208 weights the difference signal eij in accordance with the auditory sense characteristic and delivers the weighted signal wij to the square error computation block 209. The computation block 209 produces a square sum signal Eij with each component of the weighted signal wij, determines an i and j combination making the value of the signal Eij smallest, and thereby outputs the smallest i and j combination, i.e., the optimal indexes i and j. The optimal indexes i and j are fed to the excitation codebook 203 and gain table 205, respectively. At the same time, both the indexes i and j are applied to the multiplexer 212. The multiplexer 212 multiplexes the mode code information M, quantization code information L and optimal indexes i and j to form a total code signal W. The total code signal W is fed out via the output terminal 213.

As stated above, the speech coder with the modified coding circuit 301A is capable of coding speech signals efficiently.

Figure 5:
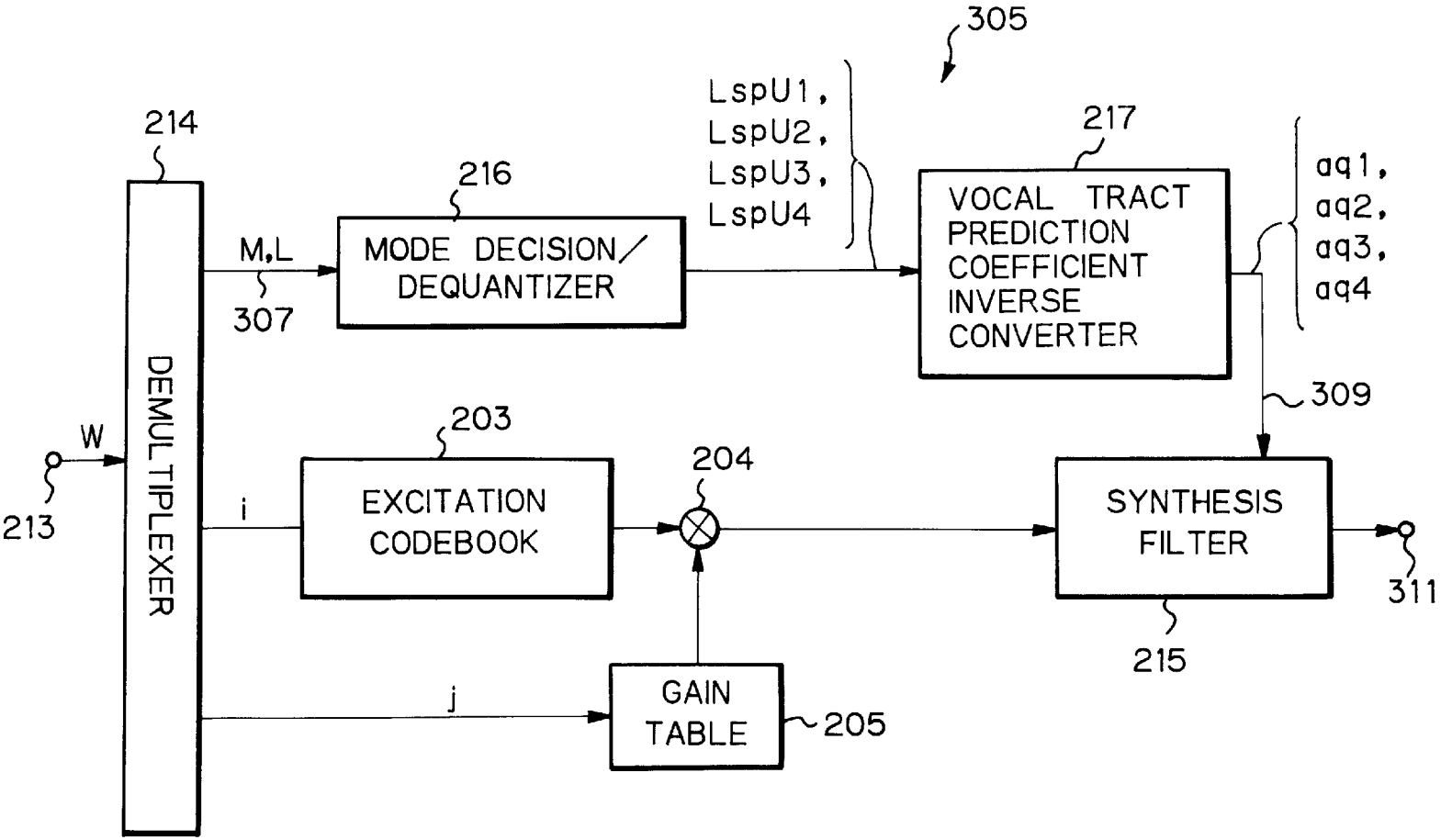
FIG. 5 is a block diagram schematically showing a speech decoder to which the decoding circuit shown in FIG. 3 is applied.

FIG. 5 shows a speech decoder implemented with the decoding circuit 305 shown in FIG. 3. In FIG. 5, structural elements identical in function with the elements shown in FIGS. 3 and 4 are designated by identical reference numerals, and a detailed description thereof will not be made in order to avoid redundancy. As shown, the speech decoder consists of a demultiplexer 214, an excitation codebook 203, a multiplier 204, a gain table 205, a synthesis filter 215, a mode decision/dequantizer 216, and a vocal tract prediction coefficient inverse converter 217.

In operation, the total code signal W received from the speech coder of FIG. 4 is input to the demultiplexer 214. The demultiplexer 214 separates the mode code information M and quantization code information L from the signal W and feeds them to the mode decision/dequantizer 216. The mode-decision/dequantizer 216 computes the LSP coefficients LspU1–LspU4 of the consecutive subframes by use of the previously stated equations. The LSP coefficients LspU1–LspU4 are applied to the inverse converter 217. The inverse converter 217 transforms the LSP coefficients to vocal tract prediction coefficients aq1–aq4, respectively, and delivers them to the synthesis filter 215.

The optimal index j also separated from the signal W by the demultiplexer 214 is fed to the gain table 205. The gain table 205 reads out gain information designated by the index j and feeds it to the multiplier 204. The other optical index i separated by the demultiplexer 214 is applied to the excitation codebook 203. The codebook 203 outputs an excitation signal designated by the index i and applies it to the multiplier 204. The multiplier 204 multiplies the excitation signal by the gain information and delivers the resulting product to the synthesis filter 215. The synthesis filter 215 produces a synthetic speech signal based on the vocal tract prediction coefficients aq1–aq4 and the product output from the multiplier 204. The synthetic speech signal appears on an output terminal 311.

In this manner, the speech decoder with the decoding circuit 305 is capable of decoding speech signals efficiently.

In summary, it will be seen that the present invention provides vocal tract prediction coefficient coding and decoding circuitry which uses quantized values when vocal tract information noticeably varies within a frame or uses interpolation values when it varies little. The circuitry is therefore capable of following the variation of vocal tract information without resorting to a high mean coding rate. The circuitry reproduces high quality faithful speech signals when applied to a speech coder/decoder.

While the present invention has been described with reference to the particular illustrative embodiment, it is not to be restricted by the embodiment. It is to be appreciated that those skilled in the art can change or modify the embodiment without departing from the scope and spirit of the present invention. For example, while only three different coding modes are shown in FIG. 2, the maximum number of modes available with the one frame, four subframes scheme is 4! (=24). However, there should be selected an adequate number of modes which does not increase the amount of codes to be transmitted to a disproportionate degree.

The present invention is practicable even to a VS (Vector Sum) CEL P coder, ID (Low Delay) CELP coder, CS (Conjugate Structure) CELP coder, or PSI CELP coder.

In practice, the excitation codebook 203 should preferably be implemented as adaptive codes, statistical codes, or noise-based codes.

The speech decoder shown in FIG. 5 and located at a receiving station may be replaced with any one of configurations taught in, e.g., Japanese patent laid-open publication Nos. 73099/1993, 130995/1994, 130998/1994, 134600/1995, and 130996/1994 if it is slightly modified.

What is claimed is:

1. Vocal tract prediction coefficient coding and decoding circuitry comprising:

a coding circuit for producing a vocal tract prediction coefficient from a speech signal input in a form of a frame including a plurality of subframes, and coding said vocal tract prediction coefficient to thereby output a coded signal; and said coding circuit comprising:

vocal tract prediction coefficient generating means for generating a vocal tract prediction coefficient with each of the plurality of subframes constituting a current frame of the speech signal;

quantizing means for determining an LSP coefficient with each of vocal tract prediction coefficients of each of the plurality of subframes, and quantizing resulting LSP coefficients to thereby output corresponding quantized LSP coefficients values; and coding mode decision means for analyzing a variation of the vocal tract prediction coefficient in the current frame on the basis of said quantized LSP coefficient values to thereby select either of a quantized mode and an interpolate mode prepared beforehand for selectively using a quantized value or an interpolation value as the individual vocal tract prediction coefficient, and generating quantize/interpolate mode information representative of the quantized mode or the interpolate mode determined and quantized LSP coefficient value information showing which of said quantized LSP coefficient values of the plurality of subframes should be sent to said decoding circuit;

a decoding circuit for receiving said coded signal from said coding circuit and reproducing a vocal tract prediction coefficient from the received coded signal;

said decoding circuit comprising:

LSP coefficient reproducing means for reproducing said LSP coefficients of the plurality of subframes of the current frame on the basis of said quantize/interpolate mode information and said quantized LSP coefficient value information; and vocal tract coefficient reproducing means for reproducing said vocal tract prediction coefficients of the plurality of subframes from said LSP coefficients of the plurality of subframes reproduced.

2. A vocal tract prediction coefficient processing system for producing a vocal tract prediction coefficient from a speech signal, said system comprising:

vocal tract prediction coefficient generating means for generating a vocal tract prediction coefficient with each of a plurality of subframes constituting a current frame of the speech signal;

quantizing means for determining an LSP coefficient with each of said vocal tract prediction coefficients of the plurality of subframes, and quantizing resulting LSP coefficients to thereby output corresponding quantized LSP coefficient values;

processing means for analyzing a variation of the vocal tract prediction coefficient in the current frame on the basis of said quantized LSP coefficient values to thereby determine either of a quantized mode and an interpolate mode prepared beforehand for selectively using a quantized value or an interpolation value as the individual vocal tract prediction coefficient; and coding mode decision means for generating, based on a result of analysis output from said processing means, quantize/interpolate mode information representative of the quantized mode or the interpolate mode determined by said processing means and quantized LSP coefficient value information showing which of said quantized LSP coefficient values of the plurality of subframes should be produced.

3. A system in accordance with claim 2, wherein said processing means produces, from a quantized LSP coefficient value of any one of a subframe of a previous frame and said quantized LSP coefficient value of a corresponding subframe of the current frame, interpolation values between said subframes, produces differences between said interpolation values and said quantized LSP coefficient values of the plurality of subframes actually determined, and outputs, if said differences are smaller than a preselected threshold, said result of analysis, determining that the variation is small.

4. A system in accordance with claim 2, further comprising a decoding circuit for reproducing said vocal tract prediction coefficients on the basis of said quantize/interpolate mode information and said quantized LSP coefficient value information, said decoding circuit comprising:

LSP coefficient reproducing means for reproducing said LSP coefficients of all the subframes constituting the current frame on the basis of said quantize/interpolate mode information and said quantized LSP coefficient value information; and vocal tract prediction coefficient reproducing means for reproducing, from said LSP coefficients of all the subframes reproduced, said vocal tract prediction coefficients of all the subframes.

5. A vocal tract prediction coefficient processing system for producing a vocal tract prediction coefficient from a speech signal, said system comprising:

vocal tract prediction coefficient generating means for generating a vocal tract prediction coefficient with each of a plurality of subframes constituting a current frame of the speech signal;

quantizing means for determining an LSP coefficient with each of said vocal tract prediction coefficients of the plurality of subframes, and quantizing resulting LSP coefficients to thereby output corresponding quantized LSP coefficient values;

processing means for analyzing a variation of the vocal tract prediction coefficient in the current frame on the basis of said quantized LSP coefficient values to thereby determine either of a quantized mode and an interpolate mode prepared beforehand for selectively using a quantized value or an interpolation value as the individual vocal tract prediction coefficient; and coding mode decision means for generating, based on a result of analysis output from said processing means, quantize/interpolate mode information representative of the quantized mode or the interpolate mode determined by said processing means and quantized LSP coefficient value information showing which of said quantized LSP coefficient values of the plurality of subframes should be produced;

wherein said processing means outputs, if the variation of the vocal tract prediction coefficient is greater than a predetermined value, said quantize/interpolate mode information for causing the quantized LSP coefficient values of the subframes to be predominantly used for outputs, if said variation is not greater than the predetermined value, the quantize/interpolate mode information for causing the interpolation values of the subframes to be predominantly used.

6. A vocal tract prediction coefficient processing system for producing a vocal tract prediction coefficient from a speech signal, said system comprising:

vocal tract prediction coefficient generating means for generating a vocal tract prediction coefficient with each of a plurality of subframes constituting a current frame of the speech signal;

quantizing means for determining an LSP coefficient with each of said vocal tract prediction coefficients of the plurality of subframes, and quantizing resulting LSP coefficients to thereby output corresponding quantized LSP coefficient values;

processing means for analyzing a variation of the vocal tract prediction coefficient in the current frame on the basis of said quantized LSP coefficient values to thereby determine either of a quantized mode and an interpolate mode prepared beforehand for selectively using a quantized value or an interpolation value as the individual vocal tract prediction coefficient; and coding mode decision means for generating, based on a result of analysis output from said processing means, quantize/interpolate mode information representative of the quantized mode or the interpolate mode determined by said processing means and quantized LSP coefficient value information showing which of said quantized LSP coefficient values of the plurality of subframes should be produced;

wherein said vocal tract prediction coefficient generating means produces said vocal tract prediction coefficients from the input speech signal or a locally reproduced synthetic speech signal subframe by subframe, said system further comprising:

speech synthesizing means for outputting a synthetic speech signal by using codes stored in an excitation codebook in one-to-one correspondence with indexes, and said vocal tract prediction coefficients;

comparing means for comparing the synthetic speech signal with the input speech signal to thereby produce a difference signal;

perceptual weighting means for weighting said difference signal with respect to an auditory sense characteristic to thereby output a weighted signal;

selecting means for selecting optimal index information for said excitation codebook in response to said weighted signal, and feeding said optimal index information to said excitation codebook; and outputting means for outputting said quantized LSP coefficient value information and said optimal index information.

7. A vocal tract prediction coefficient processing system for producing a vocal tract prediction coefficient from a speech signal, said system comprising:

vocal tract prediction coefficient generating means for generating a vocal tract prediction coefficient with each of a plurality of subframes constituting a current frame of the speech signal;

quantizing means for determining an LSP coefficient with each of said vocal tract prediction coefficients of the plurality of subframes, and quantizing resulting LSP coefficients to thereby output corresponding quantized LSP coefficient values;

processing means for analyzing a variation of the vocal tract prediction coefficient in the current frame on the basis of said quantized LSP coefficient values to thereby determine either of a quantized mode and an interpolate mode prepared beforehand for selectively using a quantized value or an interpolation value as the individual vocal tract prediction coefficient; and coding mode decision means for generating, based on a result of analysis output from said processing means, quantize/interpolate mode information representative of the quantized mode or the interpolate mode determined by said processing means and quantized LSP coefficient value information showing which of said quantized LSP coefficient values of the plurality of subframes should be produced;

further comprising a decoding circuit for reproducing said vocal tract prediction coefficients on the basis of said quantize/interpolate mode information and said quantized LSP coefficient value information, said decoding circuit comprising:

LSP coefficient reproducing means for reproducing said LSP coefficients of all the subframes constituting the current frame on the basis of said quantize/interpolate mode information and said quantized LSP coefficient value information; and vocal tract prediction coefficient reproducing means for reproducing, from said LSP coefficients of all the subframes reproduced, said vocal tract prediction coefficients of all the subframes;

wherein said vocal tract prediction coefficient generating means produces said vocal tract prediction coefficients from the input speech signal or a locally reproduced synthetic speech signal subframe by subframe, said system further comprising:

speech synthesizing means for outputting a synthetic speech signal by using codes stored in an excitation codebook in one-to-one correspondence with indexes, and said vocal tract prediction coefficients;

comparing means for comparing the synthetic speech signal with the input speech signal to thereby produce a difference signal;

perceptual weighting means for weighting said difference signal with respect to an auditory sense characteristic to thereby output a weighted signal;

selecting means for selecting optimal index information for said excitation codebook in response to said weighted signal, and feeding said optimal index information to said excitation codebook;

outputting means for outputting said quantized LSP coefficient value information and said optimal index information;

said excitation codebook for outputting an optimal excitation signal in response to said optimal index information; and a synthesis filter for synthesizing a speech based on said optimal excitation signal and said vocal tract prediction coefficients reproduced to thereby reproduce the speech signal.

8. In a speech processing system vocal tract prediction coefficient processor which produces a vocal tract prediction coefficient from an input speech signal, an arrangement comprising:

a vocal tract analyzer which receives an input speech signal in the form of frames having subframes, and outputs a respective vocal tract prediction coefficient for each subframe;

a converter/quantizer which receives the prediction coefficients from the analyzer, converts the prediction coefficients to linear spectrum pair (LSP) coefficients, and quantizes the LSP coefficients;

and a coding mode decision generator which decides how to process a current frame by deciding between a quantize mode and a interpolate mode for each subframe, based on the quantized LSP coefficients.

* * * * *